United States Patent [19]

Gillis

[11] Patent Number: 4,657,438

[45] Date of Patent: Apr. 14, 1987

[54] ADVANCING MECHANISM AND SYSTEM UTILIZING SAME FOR RAISING AND LOWERING A WORK PLATFORM

[76] Inventor: Don A. Gillis, 208 N. Western Ave., Wenatchee, Wash. 98801

[21] Appl. No.: 817,877

[22] Filed: Jan. 10, 1986

[51] Int. Cl.[4] ..... E02B 17/08

[52] U.S. Cl. ..... 405/198; 254/106; 405/196

[58] Field of Search ..... 405/196, 198, 199, 200, 405/197; 254/106

[56] References Cited

U.S. PATENT DOCUMENTS

| | | | |
|---|---|---|---|
| 3,343,372 | 9/1967 | Smulders | 405/198 |
| 3,396,945 | 8/1968 | Schreier et al. | 254/106 |
| 3,411,750 | 11/1968 | Smulders | 405/198 X |
| 3,565,400 | 2/1971 | Yamura | 254/106 |
| 4,405,115 | 9/1983 | Boyadjieff | 254/106 |
| 4,497,591 | 2/1985 | Gillis | 405/198 |

FOREIGN PATENT DOCUMENTS

| | | | |
|---|---|---|---|
| 2284012 | 4/1976 | France | 254/106 |
| 7808921 | 3/1979 | Netherlands | 254/106 |
| 2056409 | 3/1981 | United Kingdom | 254/106 |

*Primary Examiner*—Dennis L. Taylor

*Attorney, Agent, or Firm*—Delbert J. Barnard

[57] ABSTRACT

A work platform (10) is guided for up and down movement along support columns (12). Advance/retract cylinders (50, 52) are interconnected between a portion (26) of the platform (10) and a first support (28). Advance/retract cylinders (64, 66) are interconnected between the platform (10) and a second support (30). Each support is in the nature of a clamping mechanism. Each includes a pair of clamp members (32, 34) and (54, 56) which are pivotally connected together. Hydraulic cylinders (46, 48) and (60, 62) move the members (32, 34) and (54, 56) together and apart. When these members (32, 34) and (54, 46) are moved apart, they move grip pads (44, 58) into gripping contact with the support column (12). When they are moved together, they move the gripping pads (44, 58) out of contact with the support column (12). In use, one support (28, 30) is clamped to the support column (12) while the other is unclamped. The advance/retract cylinders (50, 52) or (64, 66) associated with the clamped support (28) or (30) are either advanced or retracted, for the purpose of moving the platform (10) relatively along the support column (12). At the same time, the other set of advance/retract cylinders (50, 52) or (64, 66) are either fully retracted or fully advanced, to a start position.

7 Claims, 6 Drawing Figures

ADVANCING MECHANISM AND SYSTEM UTILIZING SAME FOR RAISING AND LOWERING A WORK PLATFORM

CROSS-REFERENCE TO RELATED APPLICATIONS

This application is related to my U.S. Pat. No. 4,497,591, granted Feb. 5, 1985, and to my application Ser. No. 694,333, filed Jan. 24, 1985, and entitled "Advancing Mechanism and System Utilizing Same for Raising and Lowering a Work Platform."

TECHNICAL FIELD

This invention relates to a mechanism for stepping a movable member in position along an elongated guide member. More particularly, it relates to such a mechanism which is adapted to provide an almost continuous step-by-step movement, and to a system in which such mechanism is used for raising and lowering a work platform relative to supporting columns.

BACKGROUND ART

The general concept of a step-by-step advancing mechanism is quite old. However, a common problem with known systems is that the step-by-step movement is intermittent and slow. The devices used for causing the movement are operated to cause an increment movement. Then, movement is stopped to permit repositioning of the devices, enabling them to be used for creating the next step or increment of movement.

The advancing mechanism of the present invention includes a pair of alternating mechanisms for making step advances. While one the mechanisms is making a step advance, the other is being repositioned so that substantially immediately following the step advance it can start making the next step advance. The advancing mechanism of the present invention is especially suitable for use in raising and lowering a platform relative to its support columns.

Mechanisms which exist in the patent literature for raising and lowering platforms relative to support columns are shown by the following U.S. Pats: No. 2,841,961, granted July 8, 1958, to Joseph E. Lucas; No. 2,892,314, granted June 30, 1959, to John W. Hornsby et al.; No. 2,920,870, granted Jan. 12, 1960, to George E. Suderow; No. 2,967,400, granted Jan. 10, 1961, to James I. Grant et al.; No. 2,997,852, granted Aug. 29, 1961, to George E. Suderow; No. 3,028,143, granted Apr. 3, 1962, to David B. Cheskin; No. 3,082,607, granted Mar. 26, 1963, to John R. Sutton; No. 3,195,313, granted July 20, 1965, to Edwin P. Swatek; No. 3,605,669, granted Sept. 20, 1971, to Tsi Van Yu; No. 3,722,863, granted Mar. 27, 1973, to Isamu Itoh et al.; No. 3,797,256, granted Mar. 19, 1974, to Robert P. Giblon; No. 3,804,369, granted Apr. 16, 1974, to John R. Sutton; No. 3,967,458, granted July 6, 1976, to Ralph E. Scales; No. 3,986,368, granted Oct. 19, 1976, to Clarence W. Levingston; No. 4,070,868, granted Jan. 31, 1978, to Franz Sedlmayer et al.; No. 4,227,831, granted Oct. 14, 1980, to Darrell L. Evans; No. 4,255,069, granted Mar. 10, 1981, to Ralph D. Yielding; No. 4,265,568, granted May 5, 1981, to Robert P. Herrmann et al.; No. 4,270,877, granted June 2, 1981, to Adrianus J. Post; No. 4,325,654, granted Apr. 20, 1982, to Milton Meckler; and No. 4,362,120, granted Dec. 7, 1982, to Cornelis Dekkers.

DISCLOSURE OF THE INVENTION

The advancing mechanism of the present invention is relatively simple in its constructional makeup and is easy to operate and its use results in an almost continuous movement of the structure which is being moved by it.

In basic form, it comprises a pair of mechanisms, spaced apart along an elongated member. Each mechanism comprises at least one hydraulic cylinder having a first end which is connected to a support and a second end which is attached to a member which is to be moved relatively along the elongated member. Each support carries means by which the support is either clamped to or unclamped from the elongated member.

One of the cylinders is retracted or retracting and the other is extended or extending. In operation, one of the supports is clamped in position on the elongated member, and the cylinder attached thereto is operated for the purpose of moving a structure to which the opposite end of the cylinder is attached in position relatively along the elongated member. At the same time, the other cylinder is used for repositioning its support, so that substantially immediately following the step of movement caused by the first cylinder, the second cylinder is ready to be used for causing the next step.

In accordance with the invention, the elongated member may be fixed and the advancing mechanism of this invention is used for moving a structure relative to it. Or, the structure may be fixed and the advancing mechanism of the invention may be used for moving the elongated member relative to the structure.

There are important constructional details and specific component arrangemens which are also parts of the invention. Also, a system utilizing the above principles is a part of the invention. Such constructional details, component arrangements, and the system are described in the description of the best mode for carrying out the invention.

BRIEF DESCRIPTION OF THE DRAWINGS

In the drawings, like reference numerals are used throughout the several figures.

BEST MODE FOR CARRYING OUT THE INENTION

Figure 1:
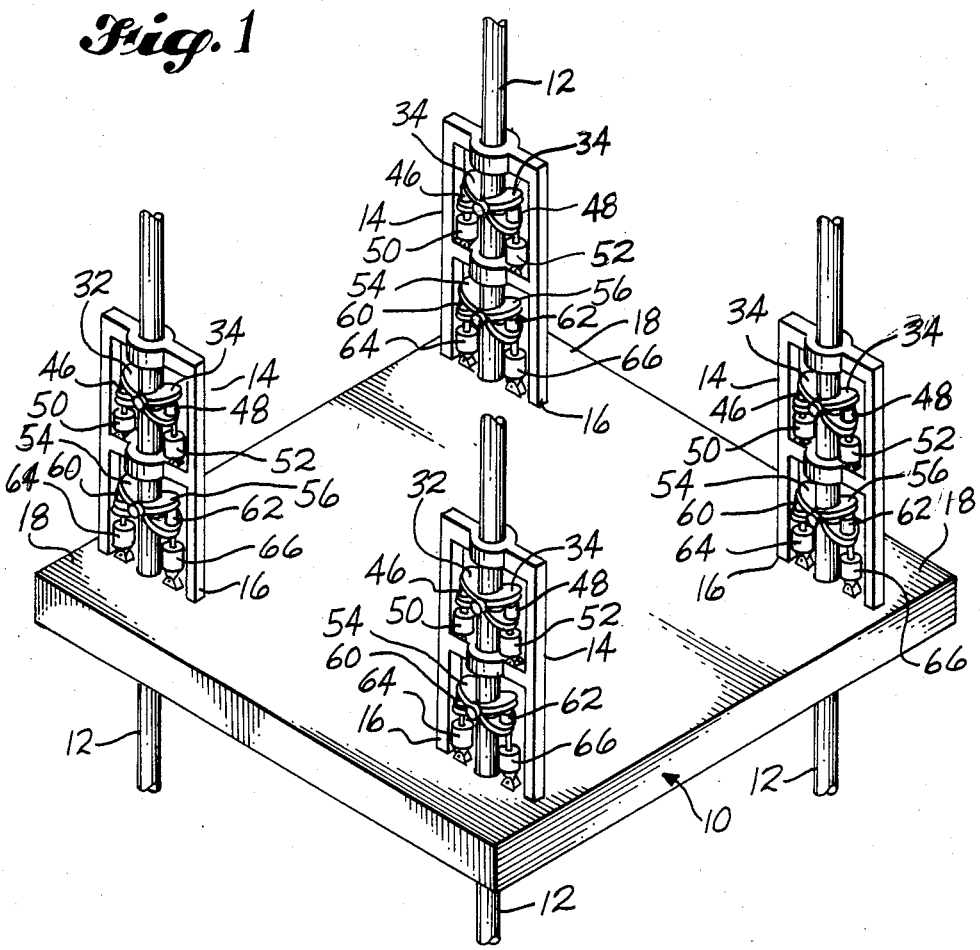
FIG. 1 is a pictorial view, taken from above and looking toward one corner of a column-supported platform, showing an advance mechanism interconnected between each column and a related corner portion of the platform.
Figure 3:
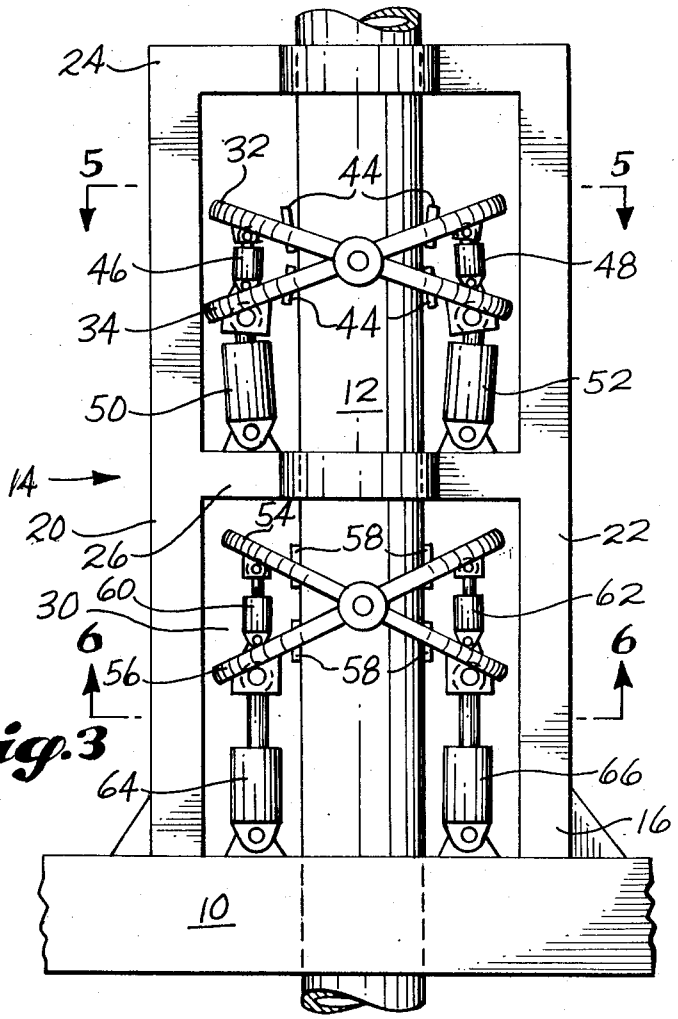
FIG. 3 is a view like FIG. 2, but showing the upper set of cylinders retracted, the upper support unclamped, the lower cylinders extended, and the lower support clamped.
Figure 2:
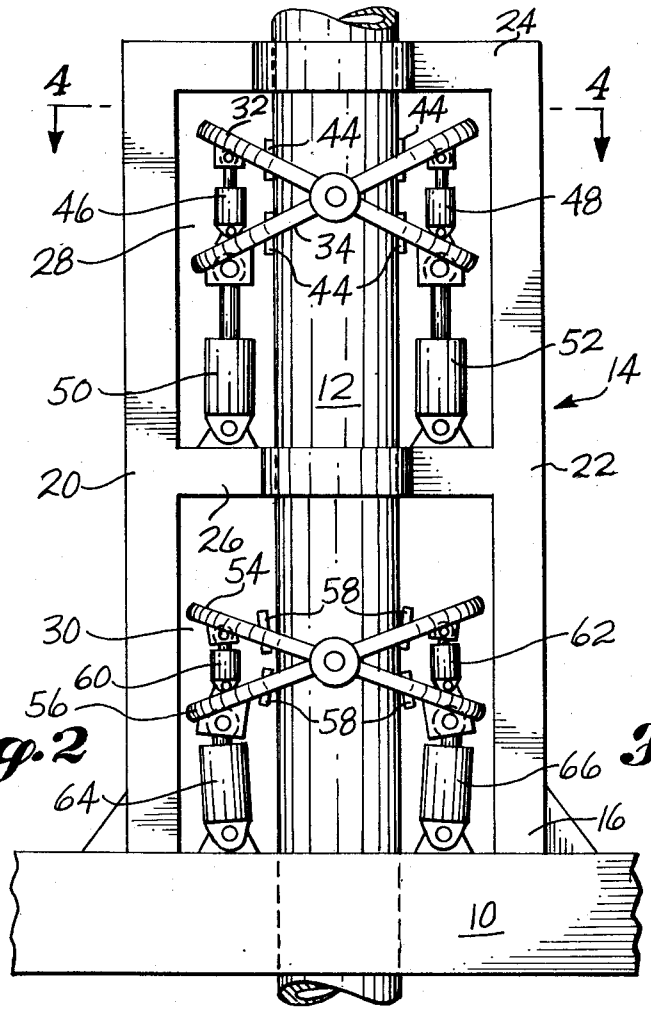
FIG. 2 is an elevational view of one of the advance mechanisms, showing an upper set of cylinders advanced, and a lower set of cylinders retracted, an upper support member clamped to a support column, and a lower support member unclamped from the support column.

Referring to FIG. 1, an offshore work platform 10 is supported at its corners by a set of support columns 12. The platform 10 is vertically movable in position relatively along the support columns 12. Movement is achieved by operation of a set of four advance mechanisms, each one of which is interconnected between one of the corner portions of the platform 10 and the column 12 at such corner.

The advancing mechanism of the present invention is especially suited for use in raising and lowering a work platform in position relatively along its support columns, and the system formed by combining the advancing mechanism with a work platform and its support columns is a very important aspect of the invention. However, the advancing mechanism has general utility and can be used for shifting many types of movable members into position relatively along many different types of elongated members, or for shifting an elongated member in position relative to a fixed member.

The advancing mechanism concepts of the invention will now be described, in conjunction with the illustrated work platform raising and lowering system.

In the illustrated embodiment, the elongated guide member is a support column 12 which may be tubular in form. A support frame 14 is secured at its lower end 16 to a corner portion 18 of the platform 10. The frame 14 comprises a pair of upright side members 20, 22, and upper cross member 24 and an intermediate cross member 26. Frame 14 is an integral portion of the platform or movable member 10.

The advancing mechanism comprises upper and lower supports 28, 30 which may be identical in construction.

Figure 4:
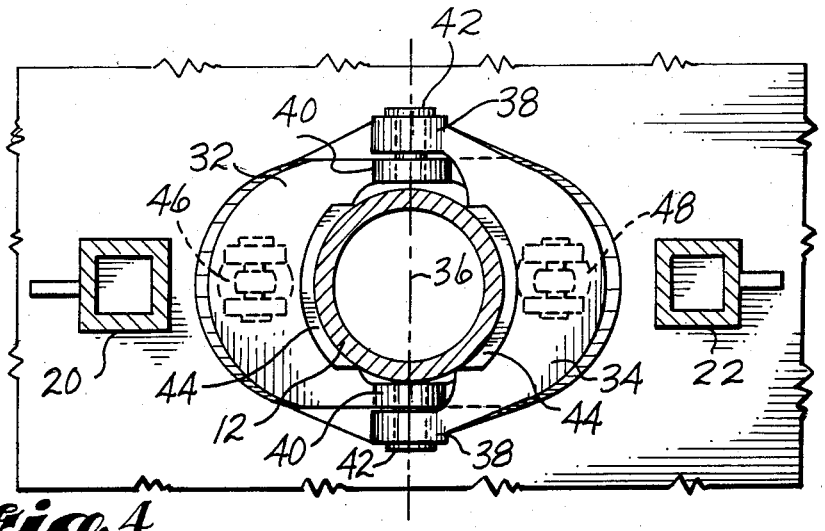
FIG. 4 is a sectional view through FIG. 2, taken substantially along line 4—4 of FIG. 2.
Figure 5:
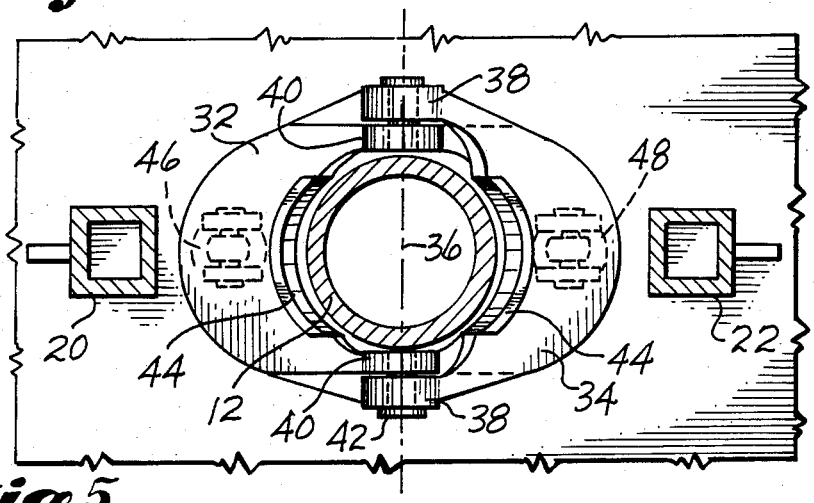
FIG. 5 is a sectional view taken substantially along line 5—5 of FIG. 3.
Figure 6:
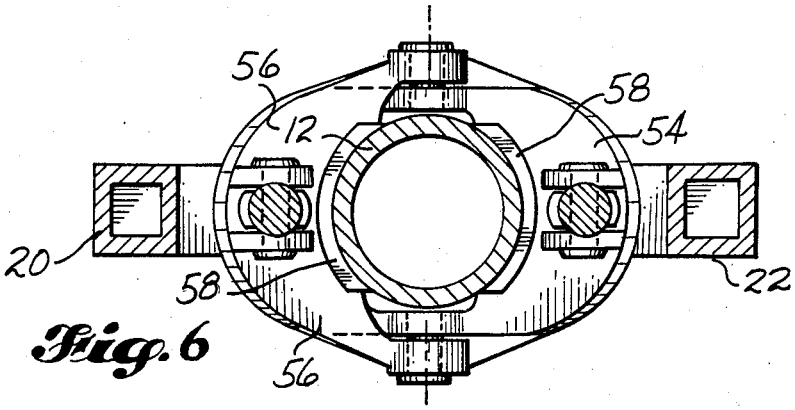
FIG. 6 is a sectional view taken substantially along line 6—6 of FIG. 3.

Each support 28, 30 comprises a pair of clamp members 32, 34. Each of members 32, 34 includes an open center in which the support column 12 is received. As best shown by FIGS. 4–6, the clamp members 32, 34 are pivotally connected together for pivotal movement about an axis 36 which extends transversely of the center axis of the support column 12. The members 32, 34 are closed figures, i.e. they include structure which extends entirely around the center opening. Ears 38 are provided on member 34 and ears 40 are provided on member 32. Pivot pins 42 extend through aligned openings in the ear 38, 40 and create the pivotal connection.

The center opening in the member 32, 34 are not circular openings. Rather, they are elongated in the direction extending crosswise of the pivotal axis 36, but have end portions of circular curvature. Grip pads 44 or the like are provided at the ends of the opening. When the members 32, 34 are moved apart, these grip pads 44 are moved into contact with the support column 12. When the members 32, 34 are moved together, the grip pads 44 move out of contact with the column 12.

The members 32, 34 are moved together and apart by means of hydraulic cylinders 46. In the illustrated embodiment the opposite ends of the hydraulic cylinders 46 are pivotally attached to outer end portions of the members 32, 34, in substantial direct alignment with advance/retract cylinders 48. The upper end of cylinder 50 is pivotally connected to a lower outer end portion of clamp member 34. In similar fashion, on the opposite sides of the support column 12, the upper end of cylinder 52 is pivotally attached to a lower outer end portion of clamp member 32. The lower ends of cylinders 50, 52 are pivotally attached to mounting ears which are a part of the cross frame 26.

Support 30 includes clamp members 54, 56, having grip pads 58. Since members 54, 56 are identical to members 32, 34, and are pivotally connected together in the same way, they will not be separately described.

Clamp members 54, 56 are moved together and apart by hydraulic cylinders 58, 60 which are interconnected between end portions of the members 54, 56, by pivotal connections at the end of the cylinders 58, 60. Cylinders 58, 60 are is substantial alignment with advance/retract cylinders 62, 64. The upper end of cylinder 62 is pivotally attached to a lower end portion of clamp member 56. On the other side of the support column 12, the upper end of cylinder 64 is pivotally attached to a lower end portion of clamp member 54. Cylinders 62, 64 are pivotally connected at their lower ends to mounting ears secured to the platform 10.

Cylinders 64, 66 have been retracted to a start position. Cylinders 50, 52 are either at or closely approaching their fully-extended position.

At the end of the extension stroke of cylinders 50, 52, the cylinders 60, 62 are extended so as to move the members 54, 56 into clamping engagement with the support column 12. After such connection has been made, the cylinders 46, 48 are retracted, permitting support 28 to be moved relatively along the support column 12. This is done by a retraction of cylinders 50, 52. At the same time, the cylinders 64, 66 are advanced to cause the next step of movement of the platform 10 relatively along the columns 12. Once cylinders 64, 66 have reached the end of their extension stroke, the cylinders 46, 48 are again extended, to again lock the upper support 28 in position on the column 12, the cylinders 60, 62 are retracted, to unlock support 30, and cylinders 50, 52 are advanced to cause the next step, while at the same time cylinders 64, 66 are retracted to a new start position.

As should be evident, the direction of advance is easily reversed. The cylinders 50, 52 are retracted while the support 28 is locked to the column 12 and the cylinders 64, 66 are extended to a new start position while the support 30 is unlocked from the support column 12.

As will be appreciated, the advancing mechanism of the present invention provides an almost continuous raising or lowering of the platform 10. Essentially immediately at the end of each increment of advancement, the second assembly of cylinders is ready to commence another step of advancement. There is no waiting for a single advancement mechanism to be repositioned so it can be used for effecting the next step.

The grip pads 44, 58 can vary in construction. It is only essential that they be able to make holding contact with the support columns 12. It is anticipated that the support columns 12 will be constructed from lengths of pipe. The outer surface of the pipe can be textured or in some manner dressed to provide a surface that can be better gripped by the pads 44, 58.

The invention is not to be limited by the details of construction which have been illustrated and described above, but only by the terms of the following claims, interpreted in accordance with rules of claim interpretation, including the Doctrine of Equivalents.

What is claimed is:

1. An advancing mechanism, comprising:

an elongated guide member;

a movable member guided for movement along said guide member;

a pair of supports spaced from each other along the guide member, each said support carrying clamping means operable for clamping the support to the guide member, for unclamping the support so that such support can be moved in position along the guide member, each said clamping means comprising a pair of jaw members, each having an open center in which the guide member is received, said jaw members being pivotally connected together along an axis which extends transversely of the guide member, said jaw members including portion bordering the open center which are brought into gripping contact with the guide member when the jaw members are moved apart, and are moved out from contact with the guide member when the jaw members are moved together; and a separate extendible/retractable hydraulic cylinder interconnected between each said support and the movable member, whereby the first one of the supports can be clamped to the guide member, while at the same time the hydraulic cylinder connected to said first support is extended or retracted to move the movable member in position relative to the first support, and at the same time the second support is unclamped from the guide member and the second cylinder is moved to a starting position, so that at the end of the stroke of the first cylinder, the second support can be clamped to the guide member, and the first support unclamped from the guide member, and then the second cylinder can be operated to advance the movable member and the first cylinder can be returned to a start position.

2. An advancing mechanism according to claim 1, comprising hydraulic cylinder means for moving the jaw members together and apart.

3. An advancing mechanism according to the claim 1 comprising a pair of hydraulic cylinders for moving the jaw members together and apart.

4. An advancing mechanism according to claim 3 wherein the hydraulic cylinders are interconnected between the jaw members at locations spaced outwardly from the guide member, on opposite sides of the pivotal axis.

5. A work platform, comprising:

a platform member;

a plurality of support columns for the platform member; and mechanism for raising and lowering the platform member along said support columns, comprising:

a pair of supports spaced apart along at least one of said support columns, each said support carrying clamping means operable for clamping the support to the support column, or unclampimg the support so that such support can be moved in position relatively along the support column, each said clamping means comprising a pair of jaw members, each having an open center in which the support column is received, said jaw members being pivotally connected together along an axis which extends transversely of the support column, said jaw members including friction surfaces bordering the open center which are brought into contact with the support column when the jaw members are moved apart and are moved out of contact with said support column when the jaw members are moved together; and a separate extendible/retractable hydraulic cylinder interconnected between each said support and the platform member, whereby a first one of the supports can be clamped to the support column, while at the same time the hydraulic cylinder connected to said first support is extended or retracted to move the platform member in position relative to the first support, and at the same time the second support is unclamped from the support column and the second cylinder is moved to a starting position, so that at the end of the stroke of the first cylinder, the second support can be clamped to the support column, and the first support unlocked from the support column, and then the second cylinder can be operated to advance the platform member and the first cylinder can be returned to a start position.

6. A work platform according to claim 5, comprising hydraulic cylinder means for moving the jaw members together and apart.

7. A work platform according to claim 5, comprising a pair of hydraulic cylinders for moving the jaw members together and apart, said hydraulic cylinders being interconnected between outer portions of the jaw members.

* * * * *